United States Patent [19]

Shenoy

[11] 4,038,544

[45] July 26, 1977

[54] APPARATUS AND METHOD FOR DEVELOPING AN ELECTROSTATIC LATENT IMAGE

[75] Inventor: Vittal U. Shenoy, Rochester, N.Y.

[73] Assignee: Xerox Corporation, Stamford, Conn.

[21] Appl. No.: 682,238

[22] Filed: May 3, 1976

[51] Int. Cl.[2] ..... G03G 15/00

[52] U.S. Cl. ..... 250/315 R; 355/3 R

[58] Field of Search ..... 250/315 R, 324, 325, 250/326; 355/3 R; 118/637

[56] References Cited

U.S. PATENT DOCUMENTS

| | | | |
|---|---|---|---|
| 3,615,395 | 10/1971 | Yamaji et al. | 355/3 R |
| 3,901,189 | 8/1975 | Fraser | 118/637 |
| 3,984,182 | 10/1976 | Gundlach et al. | 355/3 R |

*Primary Examiner*—Eli Lieberman
*Assistant Examiner*—T. N. Grigsby
*Attorney, Agent, or Firm*—Earl T. Reichert

[57] ABSTRACT

To improve the quality of copies made on an electrostatic reproduction machine, a post exposure predevelopment corona generating device is used to treat an electrostatic latent image on a photoreceptor. The device deposits a treating charge onto the latent image of the same polarity as the latent image, the treating charge being of a magnitude sufficient to lower the charge contrast between the background of the latent image and undesirable low density image areas, but not sufficient to detrimentally affect other areas of the latent image. The treating charge may be varied upwardly or downwardly to obtain the desired result, but as it is varied, an electrical bias applied to a developer is simultaneously varied in the same direction so that the magnitude of the bias is always a substantially constant amount above the magnitude of the charge on the background of the latent image.

4 Claims, 6 Drawing Figures

APPARATUS AND METHOD FOR DEVELOPING AN ELECTROSTATIC LATENT IMAGE

BACKGROUND OF THE INVENTION

The present invention relates to an improved reproduction apparatus and method, but more particularly to treating an electrostatic latent image on a photoreceptor so that an improved copy of an original document is produced.

In conventional xerography, a xerographic plate or photoreceptor comprising a layer of photosensitive insulating material (e.g., selenium) affixed to a conductive backing (e.g., nickel) is used to support electrostatic latent images. In the xerographic process, the photosensitive surface is electrostatically charged, and the charged surface is then exposed to a light pattern of the image being reproduced to thereby discharged the surface in the areas wherein light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner." Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper), and the image is affixed thereto to form a permanent record of the original document.

In the practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

For various reasons, copies of an original occasionally contain undesirable low density image areas which detract from the quality of the copy. For example, low density lines are produced when a copy is made of an original which has had correction tape applied thereto to block out matter which is not to be reproduced. Depending on the thickness of the correction tape, or on how close together adjacent pieces of correction tape are, various low density lines are produced on the copy which correspond to the edges of the correction tape. This occurs because soft shadows are formed along the edges of the correction tape by the illumination assembly used to expose the original, and thus significantly less light is transmitted from the original to the photoreceptor where these shadows are located. Thus, the charged photoreceptor is not discharged to background level in these areas, and consequently these areas of the photorecptor are developed when the latter passes the developing apparatus. Undesirable low density areas on copies are also produced by a scratched photoreceptor. These scratched areas of the photoreceptor charge to a higher level than the unstratched areas and then discharge to a higher level than the unscratched areas, and consequently these scratched areas of the photoreceptor are developed along with the image which one wishes to reproduce. Thus, these scratched areas of the photoreceptor are reproduced on the copies as undesirable low density image areas. Undesirable low density image areas may also be produced on copies simply because the original is not of good quality and contains such areas.

Also, although present high-speed electrostatic reproduction machines make excellent quality half-toner copies which are faithful reproductions of a half-tone original, they produce very poor copies of coninuous tone photographs. Copies are produced with very high contrast between light and dark grey areas of the photograph. In addition, some applications require precise reproduction of the character width and darkness on the original, and present reproduction machines do not provide for this.

SUMMARY OF THE INVENTION

A primary object of the present invention is to be able to eliminate undesirable low density image areas from copies made on an electrostatic reproduction mmachine to be able to reproduce copies of continuous toner photographs which are more like the original photograph in which the transition from light grey areas to dark grey areas is gradual rather than a sharp contrast, and to allow one to produce copies in which the character width and darkness match the original. To effect this, a post exposure predevelopment corona generating device is used to deposit a charge onto an electrostatic latent image of the same polarity as that of the image, and of a magnitude sufficient to produce the desired result.

DETAILED DESCRIPTION OF THE INVENTION

Figure 1:
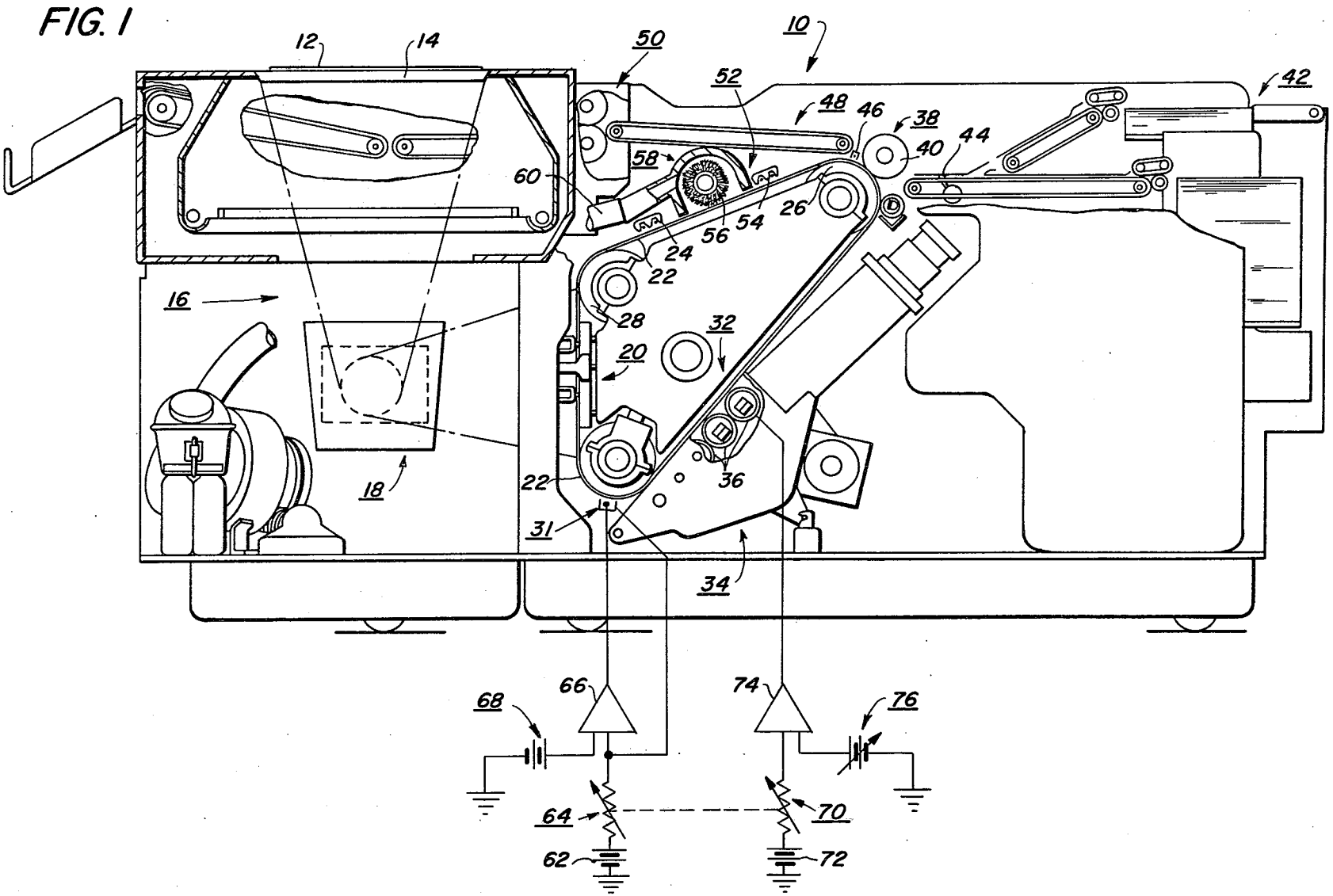
FIG. 1 is a schematic sectional view of an electrostatic reproduction machine embodying the present invention.

For a general understanding of an electrostatic reproduction machine in which the present invention may be incorporated, reference is made to the figures. As in all electrostatic reproduction machines of the type illustrated, a light image of an original is projected onto the photosensitive surface of a xerographic plate to form an electrostatic latent image thereon. Thereafter, the latent image is developed with material comprising carrier beads and oppositely charged toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support plate 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts (in the present example) by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the dark areas of the light image projected from the original on the support platen. As the belt continues its movement, the latent image passes a post exposure pre-development corona generating device 31, around the roller 30, and through a developing station 32 where a developer indicated generally by the reference numeral 34 is positioned. The corona generating device 31 treats the latent image prior to development as will be more fully explained below. The developer 34 comprises a plurality of magnetic brushes 36 which carry developing material (magnetic carrier beads and toner particles) to the surface of the upwardly moving belt 22. As the developing material is applied to the belt, toner particles which have been negatively charged through contact with the carrier beads are electrostatically attracted to the charged photosensitive surface to form a powder image (an electrostatic developed image).

The developed electrostatic image is transported by the belt 22 to a transfer station 38 where a sheet of paper is moved at a speed in synchronism with the moving belt in order to effect transfer of the developed image. Located at the transfer station 38 is a transfer roll 40 which is arranged on the frame of the machine to contact the back side of the sheet of paper as the latter is moved or fed between the belt and the transfer roll. The roll 40 is electrically biased with sufficient voltage so that the developed image on the belt may be electrostatically attracted to the adjacent side of a sheet of paper as the latter is brought into contact therewith. The transfer roll 40 applies a charge to the entire sheet as it moves between the roll and the belt 22.

A suitable sheet transport mechanism transports sheets of paper seriatim from a paper handling mechanism indicated generally by the reference numeral 42 to the developed image on the belt as the same is carried around the roller 26. In passing from the paper handling mechanism to the transfer roll 40, each sheet contacts a plurality of registration fingers 44.

As a sheet emerges from the transfer station 38, a charge is deposited thereon by a detack corona generating device 46 to lessen the electrostatic attraction between the belt 22 and the sheet so that the latter can be removed by a vacuum stripping and transport mechanism 48. The sheet is thereafter retained on the underside of the vacuum stripping and transport mechanism 48 for movement into a fuser assembly indicated generally by the reference numeral 50 wherein the powder image on the sheet is permanently affixed thereto. After fusing, the finished copy is discharged at a suitable point for collection. The toner particles remaining as residue on the belt 22 are carried by the belt to a cleaning apparatus 52. The cleaning apparatus 52 comprises a corona discharge device 54 for neutralizing charges remaining on the untransferred toner particles, a rotating brush 56 mounted within a housing 58, and a vacuum outlet 60.

Figure 2A:
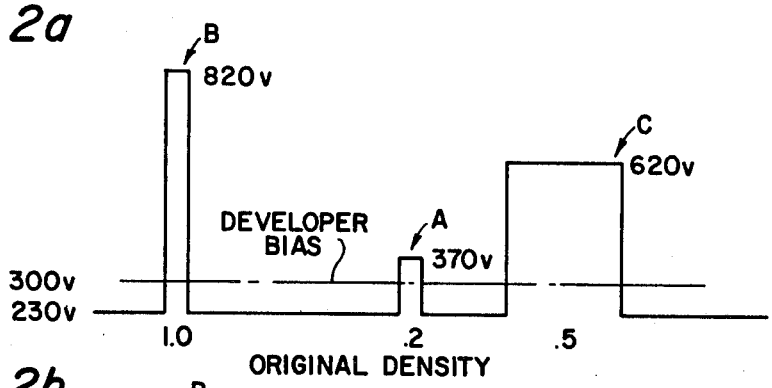
FIG. 2*a* shows a typical voltage profile for an electrostatic latent image on a photoreceptor.
Figure 2B:
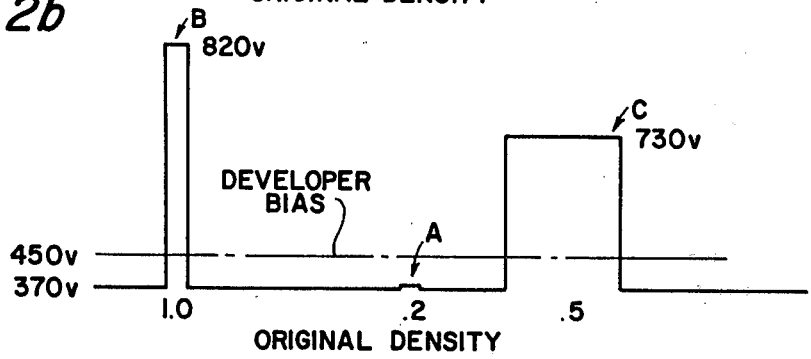
FIG. 2*b* shows a voltage profile for the electrostatic latent image in FIG. 2*a* after treating the image according to the present invention.

The operation of the present invention will now be described in more detail. FIG. 2*a* shows a typical voltage profile for an electrostatic latent image before treatment with the present invention, and FIG. 2*b* shows the voltage profile after treatment. These Figures will be discussed in more detail below. As can be seen, in the present example corona generating device 31 is positively biased by a suitable DC source 62 to treat the electrostatic latent image for any one of the reasons set forth above. By varying the resistance 64, the current between the device 31 and the photoreceptor 22 can be varied to effect the desired result, this current being in the general range of 0.63 to 5.0 microamps per inch of corona wire depending on what one is attempting to accomplish. An amplifier 66 compares the supply voltage with a reference voltage 68 to supply the proper output to the corona wire of the device 31. After the resistance 64 is adjusted to produce the desired current between the device 31 and the photoreceptor 22, this current is maintained constant by a suitable control system, the latter including means for sensing this current so that it can be regulated. Since the total input current to the device is equal to the sum of the current between the corona wire and the photoreceptor and the current between the corona wire and shield, the latter current is fed back and subtracted from the total input current in order to determine and control the current between the corona wire and photoreceptor 22. Although the particular means for maintaining this constant current forms no part of the present invention, a system for effecting the same is described in U.S. application Ser. No. 572,683 filed on Apr. 28, 1975 and assigned to Xerox Corporation, the disclosure in the latter application being incorporated by reference herein to the extent necessary. The feedback of the shield current is schematically illustrated in FIG. 1 by the line extending between the shield and the input line to the amplifier 66.

Figure 3:
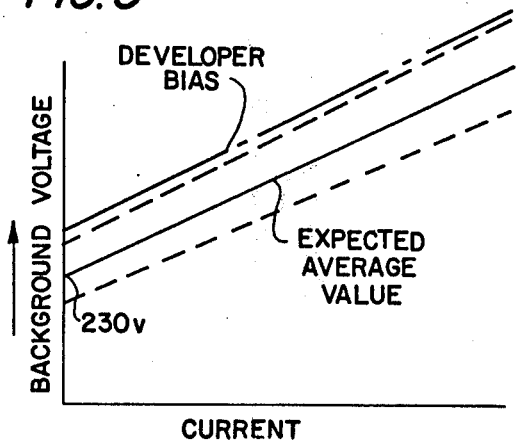
FIG. 3 shows a plot of the background voltage of an electrostatic latent image versus the current between a post exposure corona generating device and a photoreceptor.

To prevent the background of the latent image from being developed by the developer 34, the electrical bias (developer bias) on the sleeves of each of the magnetic brushes 36 must be at a level which is somewhat higher than the charge level of the background. The difference between these levels should be maintained relatively constant as shown in FIG. 3 because if the difference becomes too large, an excessive number of carrier beads become attracted to the photoreceptor and copy quality decreases. Because photoreceptors may vary somewhat in their abilities to accept a charge, an acceptable range must be defined, and this range is located between the dotted lines in FIG. 3; the level of the developer bias must be somewhat higher than the highest expected charge level on the background. In the present arrangement, an 80 volt differential between the developer bias and the average expected value of charge on the background has been found to be satisfactory. Thus, as can be seen in FIG. 1, when the current between the corona generating device 31 and the photoreceptor 22 is changed by varying the resistance 64, a resistance 70 is simultaneously varied (as indicated by the dotted line)

to change the developer bias in the same direction, i.e., if the current is increased, the developer bias is increased. As can be seen, the developer is positively biased by a suitable DC source 72, and the input voltage provided by the latter is compared by an amplifier 74 ot a reference voltage to provide the desired developer bias.

Figure 4A:
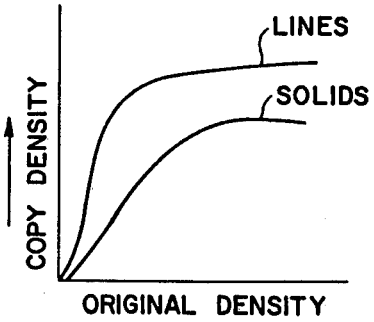
FIG. 4*a* shows a plot of the density of the image on a copy versus the density of the image on an original for a typical electrostatic reproduction machine.
Figure 4B:
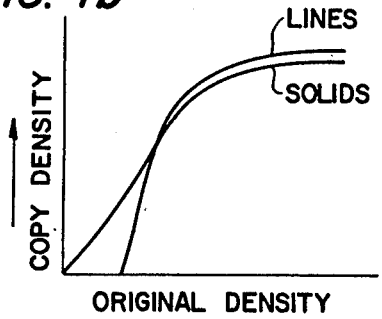
FIG. 4*b* shows the same plot illustrated in FIG. 4*a* after employing the present invention.

As an example of one situation in which the present invention may be employed, assume that copies are being made of an original having correction tape applied thereto, the original having both line and solid image areas thereon. The voltage profile of an electrostatic latent image of such an original may appear as in FIG. 2*a* where A is a low density line defining an edge of the tape as discussed above, and B and C are higher density lines and solids respectively. To suppress the low density line A, the corona generating device 31 is used to lower the voltage contrast between the low density line and the background to zero or substantially zero. Because of high electric fields of line images, positive ions emitted by the corona generating device are deposited onto the background area around the low density line to raise the background voltage level up to the same level as the voltage level of the low density line, thus preventing the development of this line. Positive ions emitted over the lines B will deflect to background areas surrounding the line and the voltage contrast will be reduced. This reduced contrast, however, will not substantially affect the development of these lines. Positive ions emitted over the solid areas C will be deposited onto both the solid and background areas because of very weak electric fields over most of the solids. Therefore, the development of solid area images will not be substantially affected. The voltage profile of the resultant electrostatic latent image after the corona treatment is shown in FIG. 2b. Thus, undesirable low density lines A caused either by the edges of the correction tape on the original, or by a scratched photoreceptor, etc., are suppressed without detrimentally affecting the other image areas. The present invention may also be used to modify the more typical development pattern shown in FIG. 4a to the more desirable pattern shown in FIG. 4b. Continuous toner images on an original may be modified so that an image is produced on a copy which is more pleasing to a particular individual. In addition, copy character width and darkness may be fine tuned to user's desire.

While the invention has been described with reference to the structure disclosed, it is not confined to the details set forth, but is intended to cover such modifications or changes as may come within the scope of the following claims.

What is claimed is:

1. The method of treating an electrostatic latent image having a background area charged to a first level, a first area charged to a second level which is higher than the first level, and a second area charged to a third level which is higher than the second level comprising:

depositing a charge onto the latent image of the same polarity as the polarity of the background and of a magnitude sufficient to substantially eliminate the contrast in charge levels between the background and the first area.

2. The method of treating an electrostatic latent image having a plurality of areas charged to different levels comprising:

depositing a charge onto the latent image of the same polarity as that of the areas to alter the charge contrast between the areas.

3. Improved apparatus for developing an electrostatic latent image on a photoreceptor which is mounted for movement around a closed path, the latent image including a background area charged to a first level, and a first area charged to a second level which is higher than the first level, including means for carrying developing material to a location adjacent the photoreceptor and means for electrically biasing the carrying means to the same polarity as the polarity of the latent image, the improvement comprising:

means for depositing ions onto the latent image which are all of the same polarity as the polarity of the latent image, and means for adjusting the rate of ion deposition onto the latent image while simultaneously adjusting the electrical bias on the carrying means in the same direction.

4. Improved apparatus as set forth in claim 3, wherein the difference between the level of the electrical bias and the level of the charge on the background area is always maintained at a substantially constant value.

* * * * *